US012053017B1

(12) United States Patent
Trapani

(10) Patent No.: US 12,053,017 B1
(45) Date of Patent: Aug. 6, 2024

(54) SNAP-OFF SMOKING DEVICE ASSEMBLY

(71) Applicant: Charles C. Trapani, Norfolk, VA (US)

(72) Inventor: Charles C. Trapani, Norfolk, VA (US)

( * ) Notice: Subject to any disclaimer, the term of this patent is extended or adjusted under 35 U.S.C. 154(b) by 421 days.

(21) Appl. No.: 17/496,890

(22) Filed: Oct. 8, 2021

(51) Int. Cl.
*A24F 1/28* (2006.01)
*A24F 1/32* (2006.01)

(52) U.S. Cl.
CPC . *A24F 1/28* (2013.01); *A24F 1/32* (2013.01)

(58) Field of Classification Search
None
See application file for complete search history.

(56) References Cited

U.S. PATENT DOCUMENTS

| | | | | |
|---|---|---|---|---|
| 31,468 | A | 2/1861 | Ludden | |
| 1,862,679 | A | 6/1932 | Holsman | |
| 10,624,388 | B2 | 4/2020 | Born et al. | |
| 10,750,777 | B2 | 8/2020 | Katz | |
| D927,775 | S | 8/2021 | Hur | |
| 2006/0180163 | A1 | 8/2006 | Thompson et al. | |
| 2008/0053466 | A1 | 3/2008 | Nathanson | |
| 2013/0167850 | A1 | 7/2013 | Al-Aawar | |
| 2017/0027219 | A1* | 2/2017 | Born | A24F 1/28 |
| 2017/0208859 | A1* | 7/2017 | Ou | C03B 23/049 |

FOREIGN PATENT DOCUMENTS

| | | | | |
|---|---|---|---|---|
| CN | 202269398 | | 6/2012 | |
| EP | 647411 | A1 * | 4/1995 | A24C 5/40 |
| EP | 0647411 | A1 | 4/1995 | |
| TW | M442714 | | 12/2012 | |

* cited by examiner

*Primary Examiner* — Michael J Felton
*Assistant Examiner* — Dang Q Pham
(74) *Attorney, Agent, or Firm* — Shaddock Law Group, PC

(57) ABSTRACT

A snap-off smoking device assembly including a base plate having a base plate passage defined therein and a base plate aperture formed therethrough; a base plate insert adapted to be slidably positioned within at least a portion of the base plate passage and repeatably slidable between a retracted position and an extended position within the base plate passage, wherein the base plate insert aperture extends through a portion of the base plate insert; and an insert release button, wherein a portion of the insert release button is positioned through the base plate insert aperture and wherein the insert release button is repeatably slidable between an engaged position and a disengaged position, wherein in the retracted position and the engaged position at least a portion of the insert release button extends through the base plate insert aperture and into at least a portion of the base plate aperture.

20 Claims, 7 Drawing Sheets

SNAP-OFF SMOKING DEVICE ASSEMBLY

CROSS-REFERENCE TO RELATED APPLICATIONS

None.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of smoking devices. More specifically, the presently disclosed systems, methods, and/or apparatuses relate to a snap-off smoking device assembly that provides individual, disposable smoking devices.

2. Description of Related Art

It is generally known to have smoking pipes and/or devices for smoking various types of marijuana, such as, for *Cannabis indica, Cannabis sativa*, or other types of hybrid *cannabis* or similar products. Generally, the smoking pipes or devices are formed of a ceramic or glass material and are constructed so as to include a bowl portion, a mouthpiece, and a choke. The pipes allow a portion of *cannabis* to be placed in a bowl or an end portion of the pipe or device. The *cannabis* can then be ignited and the resulting smoke can be inhaled through the mouthpiece.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, known smoking pipes and/or devices have various shortcomings. For example, known devices are typically formed of individual smoking pipes and/or devices and are not formed as a separable assembly.

Unfortunately, there is no current design that provides an assembly of smoking devices that can be separated from one another for individual use. These and other disadvantages of the prior art are overcome with the presently disclosed snap-off smoking device assembly, which is operable to provide an assembly of individuals devices that can be separated from one another for individual use. Additionally, the snap-off smoking device assembly is operable to allow a plurality of smoking devices or pipes to be conveniently carried at once.

In various exemplary, nonlimiting embodiments, the present disclosure is directed to a snap-off smoking device assembly formed of a portion of material with a series of spaced apart boreholes formed therethrough, along a longitudinal axis of the portion of material.

Various score lines are formed through a portion of the material (i.e., for example, through a portion of a top surface and a bottom surface of the portion of material), substantially parallel to the longitudinal axis, between each borehole. This produces a plurality of snap-off smoking devices in the portion of material, each individual snap-off smoking device separated by one or more score lines.

By bending along a score line and "snapping off" an end snap-off smoking device from the snap-off smoking device assembly, an individual snap-off smoking device can be removed from the snap-off smoking device assembly.

A portion of tobacco, *cannabis*, or other smokable material can be inserted into one end of the borehole and ignited to be smoked through the snap-off smoking device.

In various exemplary embodiments, each individual snap-off smoking device is disposable so that once it is used it can be discarded and another snap-off smoking device can be separated from the snap-off smoking device assembly for use.

These advantages of the present disclosure are preferably attained by providing a variety of snap-off smoking device assembly configurations.

The snap-off smoking device assembly of the present disclosure achieves the above-mentioned objectives through the employment of a snap-off smoking device assembly, which are characterized by comprising a body formed of a portion of material and extending from a proximal end to a distal end and having an upper side surface and a lower side surface; a series of spaced apart boreholes formed through the body, wherein each of the boreholes extends from the proximal end to the distal end; and one or more score lines formed at spaced apart locations along at least a portion of the upper side surface and/or the lower side surface, wherein each of the one or more score lines defines an area within which a discrete portion of the body can be removed from the snap-off smoking device assembly to form an individual smoking device pipe, and wherein one of the spaced apart boreholes is associated with at least one of the one or more score lines.

In various exemplary, non-limiting embodiments, the body is formed of a wood or wood material.

In various exemplary, non-limiting embodiments, the body is formed of a wood material selected from a group consisting of pine, cedar, spruce, fir, redwood, kenaf, oak, maple, cherry, mahogany, walnut, birch, ash, basswood, beech, aspen, alder, bamboo, palm, engineered wood, composite wood, and cellulosic materials.

In various exemplary, non-limiting embodiments, the body is at least partially impregnated with a material or fluid.

In various exemplary, non-limiting embodiments, the upper side surface is substantially rectangular.

In various exemplary, non-limiting embodiments, each of the one or more score lines is formed of an at least partial cut into or through the body.

In various exemplary, non-limiting embodiments, each of the one or more score lines extends substantially parallel to a longitudinal axis of the snap-off smoking device assembly.

In various exemplary, non-limiting embodiments, at least some of the one or more score lines extend from the upper side surface of the snap-off smoking device assembly and at least some of the one or more score lines extend from the lower side surface of the snap-off smoking device assembly.

In various exemplary, non-limiting embodiments, at least some of the one or more score lines extend from the upper side surface of the snap-off smoking device assembly and at least some of the one or more score lines extend from the lower side surface of the snap-off smoking device assembly, and wherein each of the one or more score lines that extends from the upper side surface is aligned with a corresponding one of the one or more score lines that extends from the lower side surface to define opposing pairs of the one or more score lines.

In various exemplary, non-limiting embodiments, each of the one or more score lines extends from the proximal end to the distal end.

In various exemplary, non-limiting embodiments, each of the one or more score lines are formed equidistant from one other.

In various exemplary, non-limiting embodiments, each of the one or more score lines includes a "V" groove.

In various exemplary, non-limiting embodiments, each of the one or more score lines includes a rounded or semicircular groove.

In various exemplary, non-limiting embodiments, each of the boreholes extends along the body, substantially parallel to a longitudinal axis of the body.

In various exemplary, non-limiting embodiments, each of the boreholes extends substantially parallel to each other of the boreholes.

In various exemplary, non-limiting embodiments, each of the boreholes extends from the proximal end to the distal end and includes an outlet portion, a throat portion, and an inlet portion.

In various exemplary, non-limiting embodiments, each of the boreholes includes a proximal recess extending from an open proximal outlet formed in the proximal end and a distal recess extending from an open distal inlet formed in the distal end, wherein a reduced diameter connector passage is formed between the proximal recess and the distal recess, and wherein the reduced diameter connector passage has a reduced inner diameter when compared to an inner diameter of the proximal recess and/or an inner diameter of the distal recess.

In various exemplary, non-limiting embodiments, the reduced diameter connector passage provides fluid communication between the proximal recess and the distal recess.

In various exemplary, non-limiting embodiments, the reduced diameter connector passage is formed closer to the distal end than to the proximal end.

In various exemplary, non-limiting embodiments, an indicia is included in or on a portion of the upper side surface of the body.

In various exemplary, non-limiting embodiments, the portion of material can be formed of wood or other materials.

In various exemplary, non-limiting embodiments, the boreholes may have a constant inner diameter or may have multiple inner diameters along the length of the borehole.

In various exemplary, non-limiting embodiments, the score lines may be relatively square, producing relatively square snap-off smoking devices, may be rounded, producing rounded snap-off smoking device, or can be of any other desired shape or contour.

In certain exemplary, nonlimiting embodiments, the snap-off smoking device assembly of the present disclosure includes at least some of a body extending from a proximal end to a distal end and having an upper side surface and a lower side surface; spaced apart boreholes formed through the body, wherein each of the boreholes extends from the proximal end to the distal end; and score lines formed at spaced apart locations along at least a portion of the upper side surface and/or the lower side surface, wherein each of the score lines defines an area within which a discrete portion of the body can be removed from the snap-off smoking device assembly to form an individual smoking device pipe, and wherein a single, discrete one of the spaced apart boreholes is associated with each individual smoking device pipe.

In certain exemplary, nonlimiting embodiments, the snap-off smoking device assembly of the present disclosure includes at least some of a body extending from a proximal end to a distal end and having an upper side surface and a lower side surface; spaced apart boreholes formed through the body, wherein each of the boreholes extends from the proximal end to the distal end, wherein each of the boreholes includes a proximal recess extending from an open proximal outlet formed in the proximal end and a distal recess extending from an open distal inlet formed in the distal end, wherein a reduced diameter connector passage is formed between the proximal recess and the distal recess, and wherein the reduced diameter connector passage has a reduced inner diameter when compared to an inner diameter of the proximal recess and/or an inner diameter of the distal recess; and score lines formed at spaced apart locations along at least a portion of the upper side surface and/or the lower side surface, wherein each of the score lines extends from the proximal end to the distal end, wherein each of the score lines defines an area within which a discrete portion of the body can be removed from the snap-off smoking device assembly to form an individual smoking device pipe, and wherein a single, discrete one of the spaced apart boreholes is associated with each individual smoking device pipe.

Accordingly, the snap-off smoking device assembly of the present disclosure separately and optionally provides an assembly of individuals devices that can be separated from one another for individual use.

The snap-off smoking device assembly of the present disclosure separately and optionally provides an assembly that is operable to allow a plurality of smoking devices or pipes to be conveniently carried together.

The snap-off smoking device assembly of the present disclosure separately and optionally provides an assembly that can be quickly and easily disassembled into a plurality of individual devices.

The snap-off smoking device assembly of the present disclosure separately and optionally provides an assembly that can be formed of a disposable material.

The snap-off smoking device assembly of the present disclosure separately and optionally provides individual smoking devices that can be single use, disposable devices.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the present disclosure. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the presently disclosed systems, methods, and/or apparatuses are disclosed herein; however, it is to be understood that the disclosed embodiments are merely exemplary of the presently disclosed systems, methods, and/or apparatuses that may be embodied in various and alternative forms, within the scope of the presently disclosed systems, methods, and/or apparatuses. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems, methods, and/or apparatuses.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
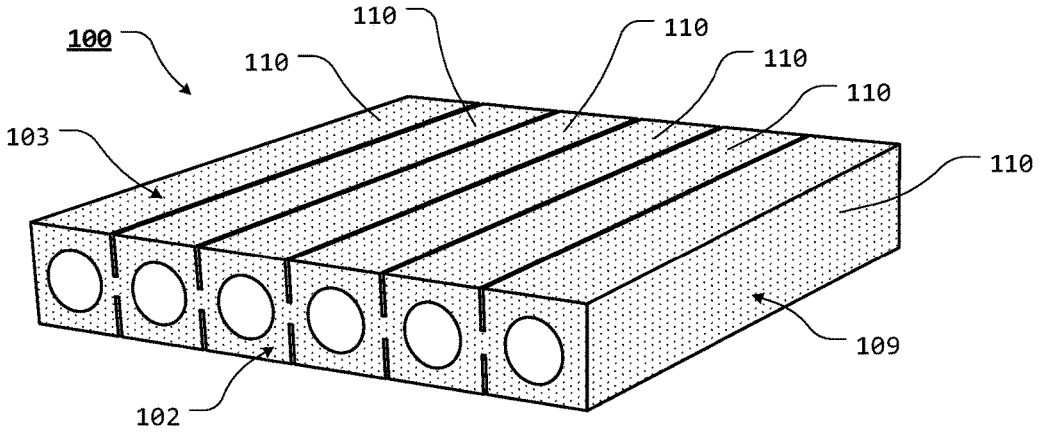
FIG. 1 illustrates an upper, perspective view of an exemplary embodiment of a snap-off smoking device assembly attach, according to the presently disclosed systems, methods, and/or apparatuses.

For simplicity and clarification, the design factors and operating principles of the snap-off smoking device assembly according to the presently disclosed systems, methods, and/or apparatuses are explained with reference to various exemplary embodiments of a snap-off smoking device assembly according to the presently disclosed systems, methods, and/or apparatuses. The basic explanation of the design factors and operating principles of the snap-off smoking device assembly is applicable for the understanding, design, and operation of the snap-off smoking device assembly of the presently disclosed systems, methods, and/or apparatuses. It should be appreciated that the snap-off smoking device assembly can be adapted to many applications where a smoking device or pipe can be used.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "front" and "rear", "top" and "bottom", "upper" and "lower", and "horizontal" and "vertical" are used as a naming convention to arbitrarily distinguish between the exemplary embodiments and/or elements such terms describe. Thus, these terms are not necessarily intended to indicate temporal or other prioritization of such exemplary embodiments and/or elements, but are used to help differentiate between certain of the components of the present disclosure and are not to be construed as limiting the present disclosure.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

The terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, device, and/or apparatus that "comprises", "has", "includes", or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

It should also be appreciated that, for simplicity and clarification, the embodiments of the present disclosure will be described using the terms "upper side" and "lower side". However, it should be understood that these terms are merely used to aid in understanding of the present disclosure are not to be construed as limiting the systems, methods, devices, and/or apparatuses of the present disclosure. Thus, it should be appreciated that the design factors and operating principles of the snap-off smoking device assembly described herein may be used in a "mirror image" snap-off smoking device assembly, where in the elements described as being included in or on the upper side are included in or on the lower side of the snap-off smoking device assembly. Alternatively, certain of the elements that are described as being included in or on the lower side of the snap-off smoking device assembly may be included in or on the upper side of the snap-off smoking device assembly, or vice versa.

It should also be appreciated that the terms "smoking device", "pipe", "snap-off", "smoking device assembly", and "snap-off smoking device assembly" are used for a basic explanation and understanding of the operation of the systems, methods, and apparatuses of the present disclosure. Therefore, the terms "smoking device", "pipe", "snap-off", "smoking device assembly", and "snap-off smoking device assembly" are not to be construed as limiting the systems, methods, and apparatuses of the present disclosure.

Furthermore, it should be appreciated that, for simplicity and clarification, the embodiments of the present disclosure will be described with reference to a snap-off smoking device assembly for smoking *cannabis*. However, it should be appreciated that the operating principles of the disclosed snap-off smoking device assembly may also be employed to construct a snap-off smoking device assembly for use in smoking various types of marijuana, such as, for *Cannabis indica, Cannabis sativa*, or other types of hybrid *cannabis*, tobacco, or similar products.

Turning now to the appended drawing figures, FIGS. 1-15 illustrate certain elements, components, and/or aspects of a snap-off smoking device assembly 100 and/or an individual smoking device pipe 110. It should be appreciated that, by way of illustration and not limitation, the snap-off smoking device assembly 100 is illustrated as having a series of spaced apart boreholes 120 formed therethrough and a plurality of score lines 105 formed at spaced apart locations along at least a portion of an exterior surface of the snap-off smoking device assembly 100.

The snap-off smoking device assembly 100 comprises a body 109 formed of a portion of material and extending from a proximal end 101 to a distal end 102 and having an upper side surface 103 and a lower side surface 104. In various exemplary embodiments, the body 109 is formed of a wood or wood material, such as, for example, one or more of pine, cedar, spruce, fir, redwood, kenaf, oak, maple, cherry, mahogany, walnut, birch, ash, basswood, beech, aspen, alder, bamboo, palm, an engineered or composite wood, other cellulosic materials, or various combinations of the foregoing.

It should be appreciated that, for simplicity and clarification, the term wood or wood material will be used. It should be understood that the terms wood and wood material are not to be construed as limiting this invention, but are intended to be illustrative and, therefore, are to be given their broadest meanings. It should be appreciated that the particular wood or wood material used to form the body 109 is a design choice based on the desired appearance, durability, characteristics, and/or functionality of the snap-off smoking device assembly 100.

In various exemplary, nonlimiting embodiments, the material used to form the body 109 may also optionally be completely or partially impregnated with another material or fluid to provide additional flavoring and/or to impart other properties to the body 109.

In various exemplary embodiments, the body 109 is substantially rectangular. However, the snap-off smoking device assembly 100 is not limited to having a substantially rectangular shaped body 109 and the body 109 may be formed or constructed having an any desired overall size and/or shape. It should also be understood that the overall size and shape of the snap-off smoking device assembly 100, and the various portions thereof, is a design choice based upon the desired functionality, compatibility, and/or appearance of the snap-off smoking device assembly 100.

The structure or material of the snap-off smoking device assembly 100 may make it difficult to bend, break, or snap-off a portion of the material along a desired line. Therefore, the body 109 has a plurality of score lines 105 formed at spaced apart locations along a portion of the snap-off smoking device assembly 100. Providing a one or more score lines 105 allows the material of the snap-off smoking device assembly 100 to be more easily bent, broken, or snapped-off along a desired line, to more easily form an even or consistent break of desired portions of the snap-off smoking device assembly 100 to form individual smoking device pipes 110.

In certain exemplary, nonlimiting embodiments, each of the one or more score lines 105 is formed of a complete or partial cut, recess, depression, or complete or partial perforation, into or through the body 109, extending substantially parallel to the longitudinal axis, $A_L$, of the snap-off smoking device assembly 100.

In various exemplary embodiments, the one or more score lines 105 may be formed of a compressed area of the snap-off smoking device assembly 100, without creating a cut. Alternatively, the one or more score lines 105 may be formed of a partial cut through the body 109.

In certain exemplary embodiments, as illustrated, for example, in FIGS. 1-4, one or more score lines 105 are formed so as to extend from a portion of the upper side surface 103 of the snap-off smoking device assembly 100 and one or more score lines 105 are formed so as to extend from a portion of the lower side surface 104 of the snap-off smoking device assembly 100. In these exemplary embodiments, the score lines 105 extending from the upper side 13 and the score lines 105 extending from the lower side surface 104 are formed as opposing pairs of score lines 105, which extend toward one another, forming a web 107 between each of the opposing pairs of score lines 105.

In certain exemplary embodiments, each of the one or more score lines 105 is formed so as to extend colinear with and substantially parallel to the longitudinal axis, $A_L$, of the snap-off smoking device assembly 100.

In certain exemplary embodiments, each of the one or more score lines 105 extends from the proximal end 101 to the distal end 102. Alternatively, the one or more score lines 105 may extend from an area proximate the proximal end 101 to an area proximate the distal end 102.

The one or more score lines 105 provides a remaining portion of material, forming a web 107, along which the snap-off smoking device assembly 100 may be comparatively more easily bent or folded, whether along the grain or against the grain of the snap-off smoking device assembly 100. Thus, the one or more score lines 105 may optionally provide a reduced or weakened area or portion of the snap-off smoking device assembly 100, along which the snap-off smoking device assembly 100 may be comparatively more easily bent, folded, or broken.

Figure 2:
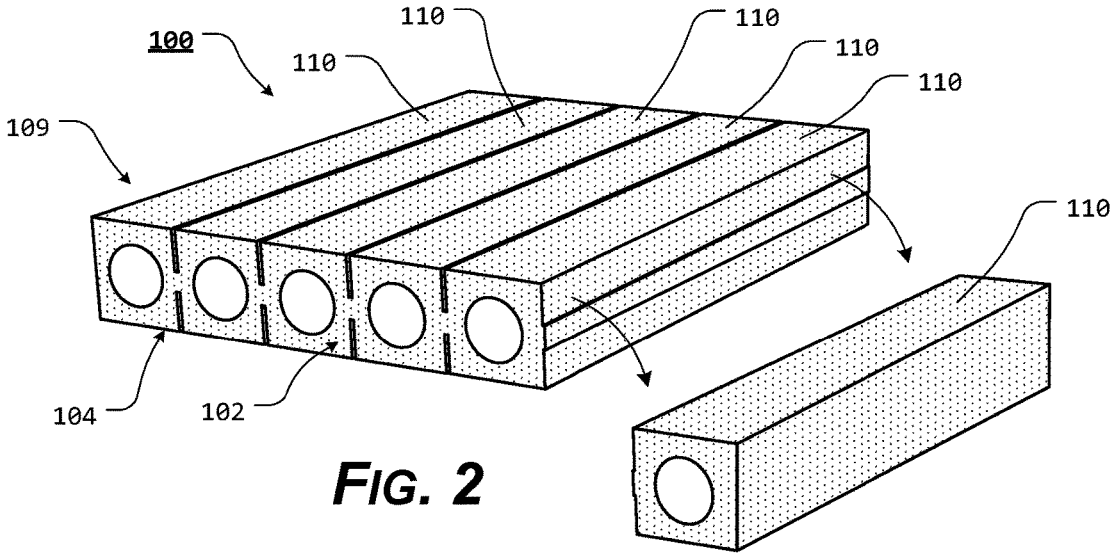
FIG. 2 illustrates an upper, perspective view of an exemplary embodiment of a snap-off smoking device assembly, wherein an individual smoking device is illustrated separated from the smoking device assembly, according to the presently disclosed systems, methods, and/or apparatuses.
Figure 3:
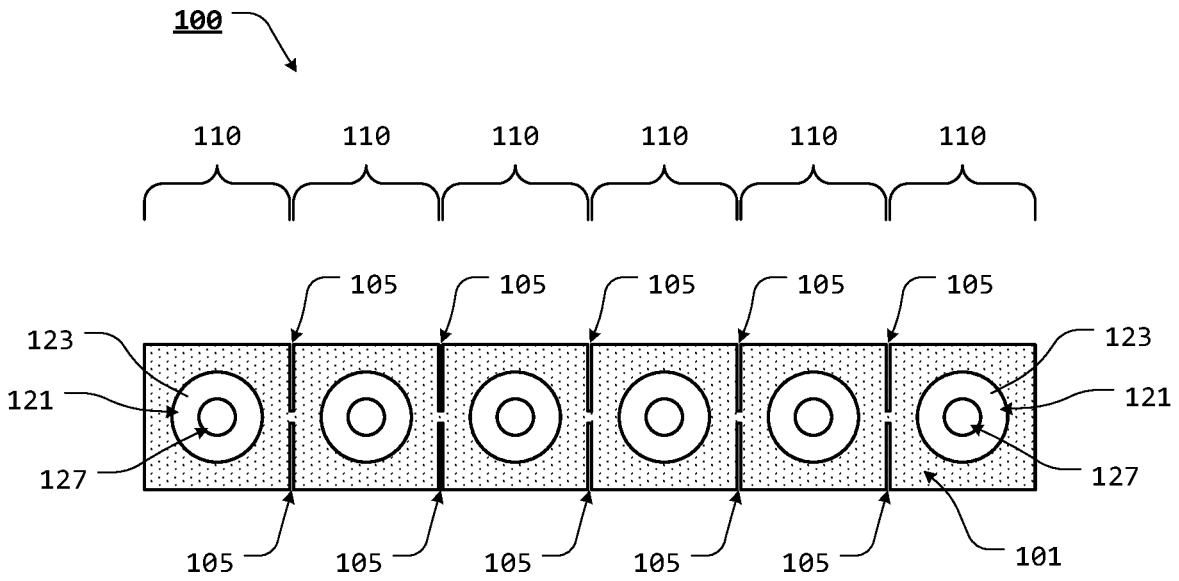
FIG. 3 illustrates a front, or proximal, view of an exemplary embodiment of a snap-off smoking device assembly, according to the presently disclosed systems, methods, and/or apparatuses.
Figure 4:
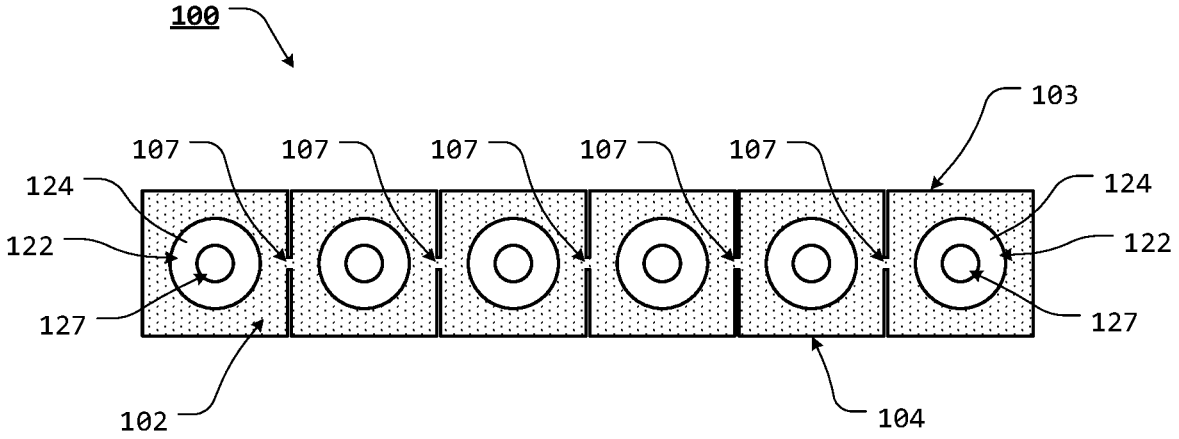
FIG. 4 illustrates a rear, or distal, view of an exemplary embodiment of a snap-off smoking device assembly, according to the presently disclosed systems, methods, and/or apparatuses.
Figure 5:
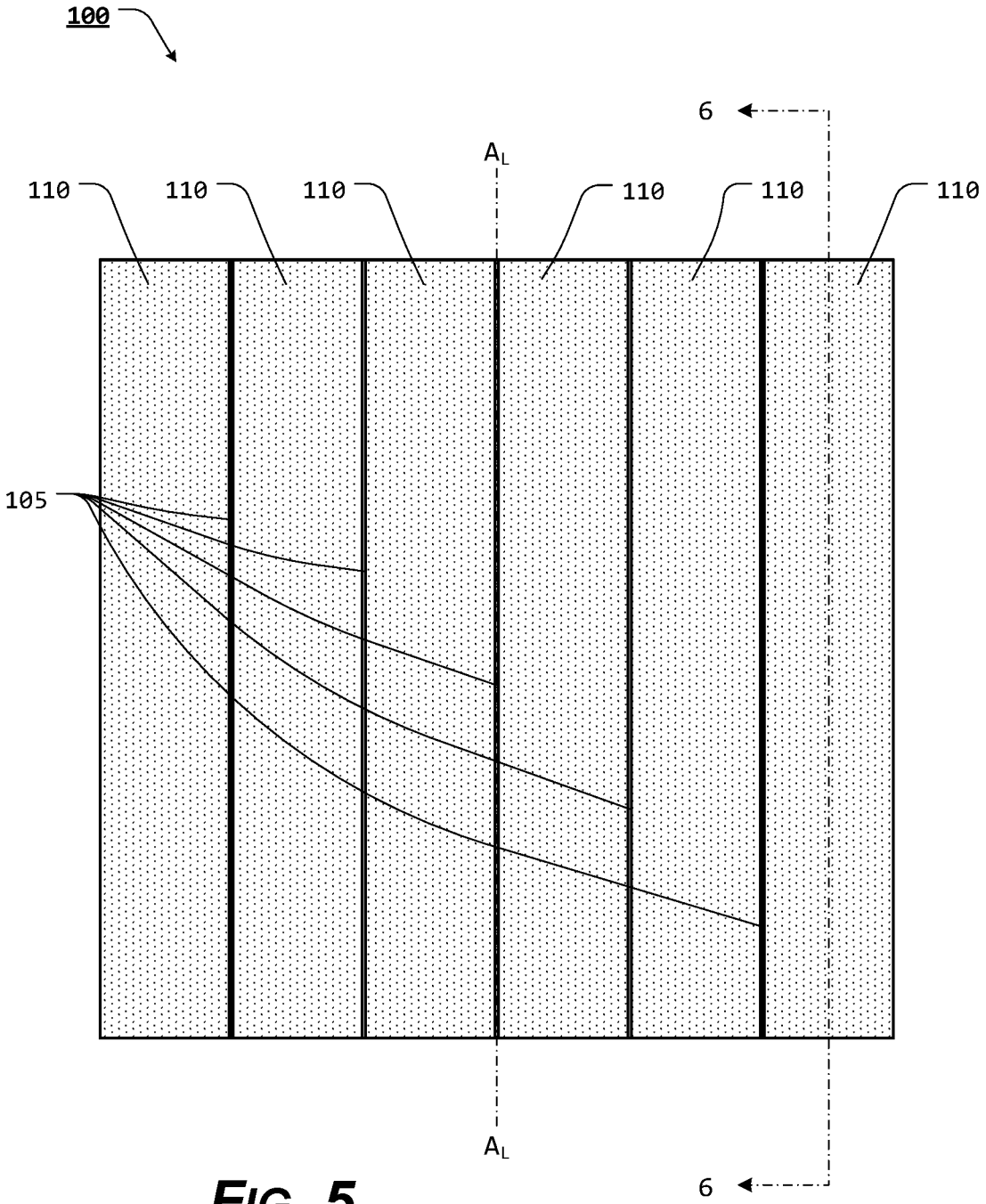
FIG. 5 illustrates a top view of an exemplary embodiment of a snap-off smoking device assembly, according to the presently disclosed systems, methods, and/or apparatuses.

By bending, folding, or breaking the snap-off smoking device assembly 100 along the one or more score lines 105, as illustrated by the semicircular arrows in FIG. 2, a portion of the snap-off smoking device assembly 100 can be more easily separated or broken off of the snap-off smoking device assembly 100 to allow an individual smoking device pipe 110 to be removed from the snap-off smoking device assembly 100. Once an individual smoking device pipe 110 is removed from the snap-off smoking device assembly 100, it can be used as a smoking device.

In certain exemplary embodiments, each of the one or more score lines 105 are formed equidistant from each other. Alternatively, the one or more score lines 105 may be formed at varying distances from one another.

As illustrated, five opposing pairs of score lines 105 are formed in the snap-off smoking device assembly 100, resulting in six potential individual smoking device pipes 110. However, it should be appreciated that the number of score lines 105 and/or opposing pairs of score lines 105 utilized to form the snap-off smoking device assembly 100 is a design choice, based upon the overall size and/or shape of the snap-off smoking device assembly 100, the number of individual smoking device pipes 110 to be provided by a given snap-off smoking device assembly 100, or other factors.

Figure 11:
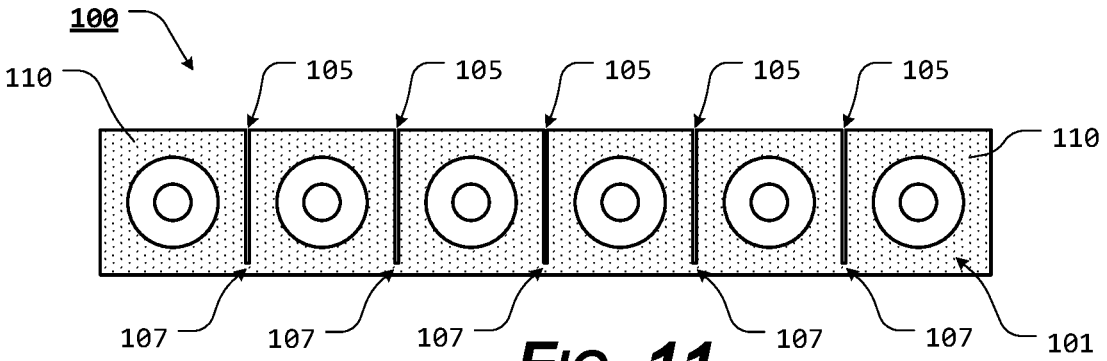
FIG. 11 illustrates a front, or proximal, view of an exemplary embodiment of a snap-off smoking device assembly, according to the presently disclosed systems, methods, and/or apparatuses.
Figure 12:
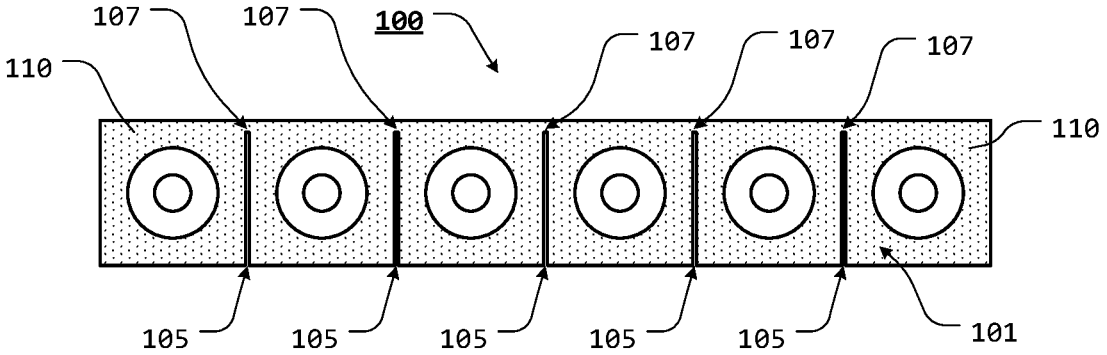
FIG. 12 illustrates a front, or proximal, view of an exemplary embodiment of a snap-off smoking device assembly, according to the presently disclosed systems, methods, and/or apparatuses.

Additionally, while opposing pairs of score lines 105 are illustrated in FIGS. 1-4 and 13-14, the present disclosure is not so limited. For example, as illustrated in FIG. 11, the one or more score lines 105 may optionally be formed so as to extend solely from a portion of the upper side surface 103 of the snap-off smoking device assembly 100, forming the webs 107 proximate the lower side surface 104. Alternatively, as illustrated in FIG. 12, the one or more score lines 105 may optionally be formed so as to extend solely from a portion of the lower side surface 104 of the snap-off smoking device assembly 100, forming the webs 107 proximate the upper side surface 103. Thus, it should be appreciated that score lines 105 may be formed so as to extend from a portion of the upper side surface 103, extend from a portion from the lower side surface 104, or from both the upper side surface 103 and the lower side surface 104.

In various exemplary embodiments, the score lines 105 are relatively square, producing individual smoking device pipes 110 that are relatively square, as viewed from the proximal end 101 or the distal end 102.

Figure 13:
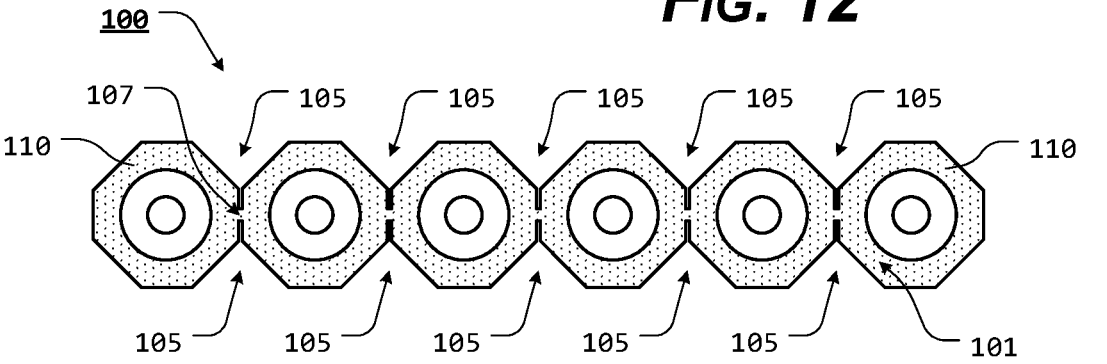
FIG. 13 illustrates a front, or proximal, view of an exemplary embodiment of a snap-off smoking device assembly, according to the presently disclosed systems, methods, and/or apparatuses.

Alternatively, as illustrated in FIG. 13, the score lines 105 may include a "V" groove cut into the upper side surface 103 and the lower side surface 104 of the snap-off smoking device assembly 100. In this manner, individual smoking device pipes 110 are produced that are substantially octagonal, as viewed from the proximal end 100 or the distal end 102. In various exemplary embodiments, the "V" groove cut may extend to form web 107. Alternatively, the "V" groove cut may extend into a portion of the body 109, but not so far as to extend to the web 107.

Figure 14:
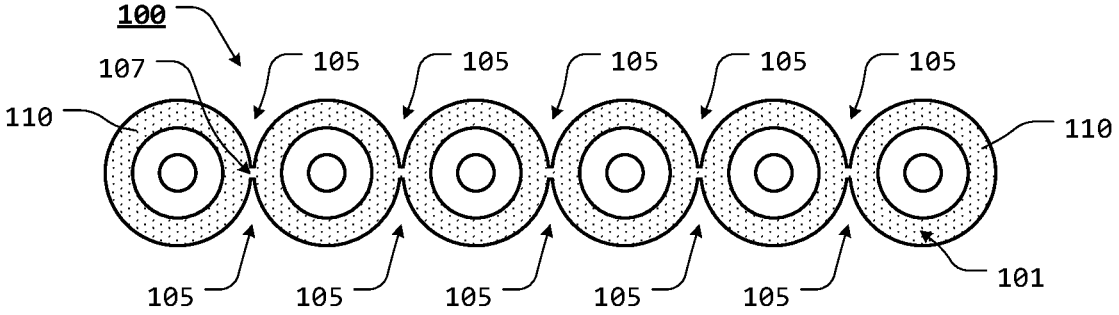
FIG. 14 illustrates a front, or proximal, view of an exemplary embodiment of a snap-off smoking device assembly, according to the presently disclosed systems, methods, and/or apparatuses.
Figure 15:
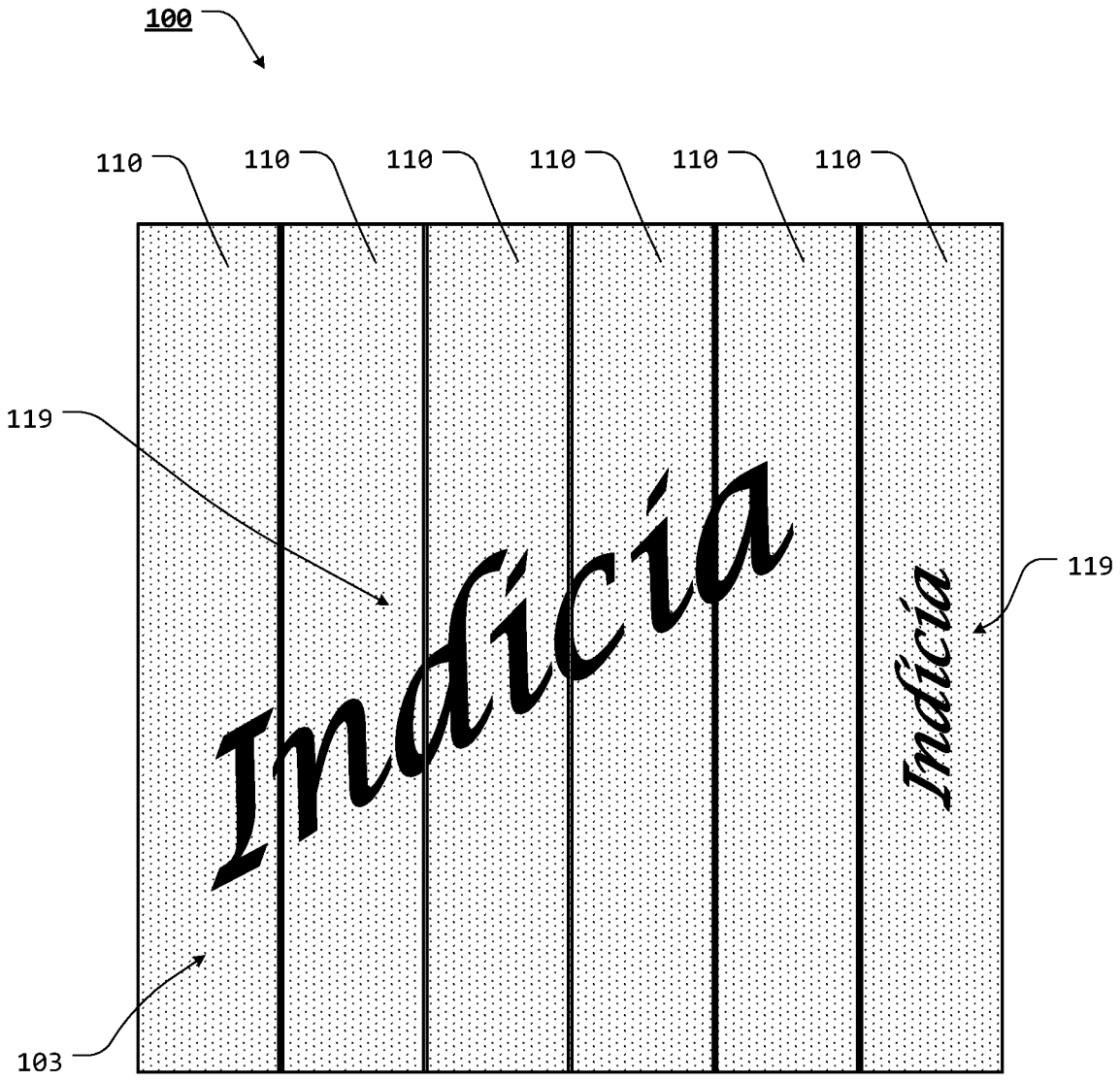
FIG. 15 illustrates a top view of an exemplary embodiment of a snap-off smoking device assembly, according to the presently disclosed systems, methods, and/or apparatuses.

In still other exemplary embodiments, as illustrated in FIG. 14, the score lines 105 may include a rounded or semicircular groove cut into the upper side surface 103 and the lower side surface 104 of the snap-off smoking device assembly 100. In this manner, individual smoking device pipes 110 are produced that are substantially circular, as viewed from the proximal end 101 or the distal end 102, producing a substantially cylindrical individual smoking device pipe 110. In various exemplary embodiments, the rounded or semicircular groove cut may extend to form web 107. Alternatively, the rounded or semicircular groove cut may extend into a portion of the body 109, but not so far as to extend to the web 107.

Thus, it should be appreciated that each of the score lines 105 may be substantially square, substantially rounded, or can be of any other desired shape, profile, or contour.

A plurality or series of spaced apart boreholes 120 are formed through the snap-off smoking device assembly 100. Each borehole 120 extends along the body 109, substantially colinear with and substantially parallel to the longitudinal axis, $A_L$, of the snap-off smoking device assembly 100. Each borehole 120 also extends substantially colinear with and substantially parallel to each other borehole 120. Each borehole 120 is included within a portion of the body 109, such that a single, discrete borehole 120 is associated with each individual smoking device pipe 110.

Each borehole 120 extends from the proximal end 101 to the distal end 102 and includes an outlet portion 112, a throat portion 116, and an inlet portion 114. Thus, each borehole 120 provides a generally cylindrical outlet section, provided by the outlet portion 112, followed by a convergent portion, provided by the throat portion 116, which is followed by a divergent inlet section, provided by the inlet portion 114.

More specifically, each borehole 120 includes a substantially cylindrical proximal recess 121 defined by one or more proximal recess side walls 131 extending from an open proximal outlet 123 formed in the proximal end 101 and a substantially cylindrical distal recess 122 defined by one or more distal recess side walls 132 extending from an open distal inlet 124 formed in the distal end 102.

A reduced diameter connector passage 127 is formed between the proximal recess 121 and the distal recess 122. The reduced diameter connector passage 127 is defined by one or more intermediate projections 128 extending into a portion of the borehole 120. In various exemplary embodiments, the reduced diameter connector passage 127 is formed closer to the distal end 102 than to the proximal end 101. The intermediate projection 128 includes a proximal shoulder 125 and a distal shoulder 126. Thus, the proximal recess 121 extends from the open proximal outlet 123 to the proximal shoulder 125 of the intermediate projection 128. The distal recess 122 extends from the open distal inlet 124 to the distal shoulder 126 of the intermediate projection 128. The reduced diameter connector passage joins the proximal recess 121 and the distal recess 122, providing fluid communication between the proximal recess 121 and the distal recess 122.

Figure 6:
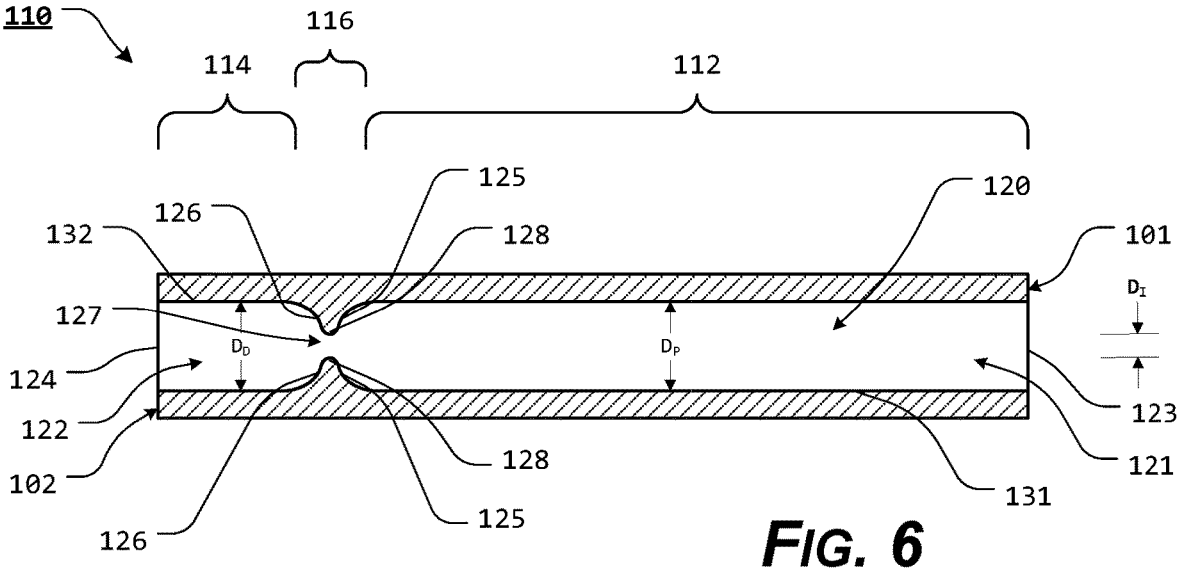
FIG. 6 illustrates a side, cross-sectional view of an exemplary embodiment of a snap-off smoking device, taken along line 6-6 of FIG. 5, according to the presently disclosed systems, methods, and/or apparatuses.
Figure 7:
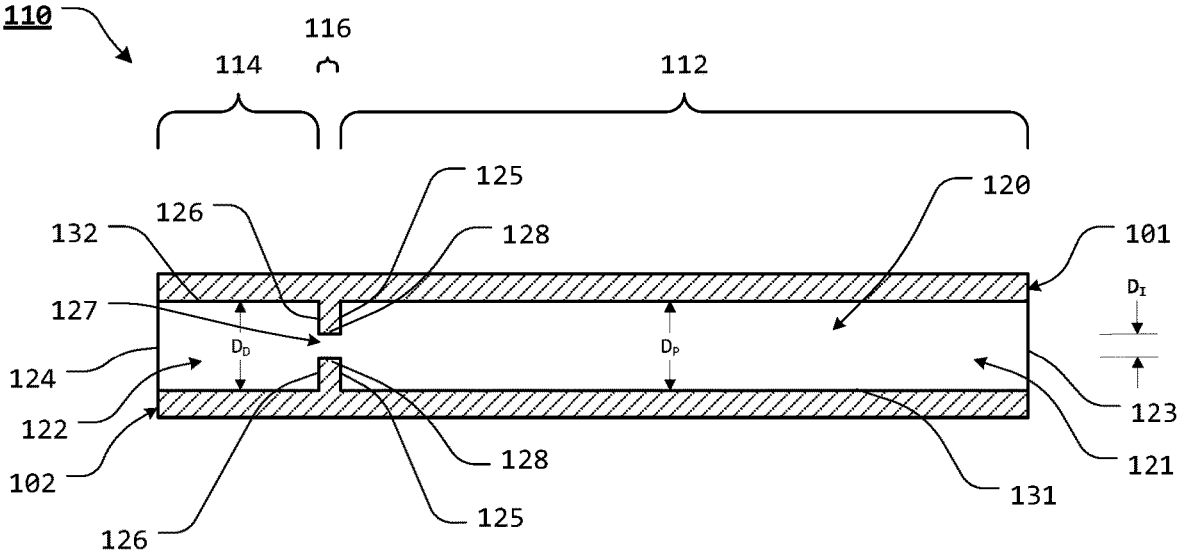
FIG. 7 illustrates a side, cross-sectional view of an exemplary embodiment of a snap-off smoking device, according to the presently disclosed systems, methods, and/or apparatuses.

In certain exemplary embodiments, as illustrated in FIG. 6, the transition between the inner proximal recess side walls 131 of the proximal recess 121 and the proximal shoulder 125 may optionally be curved or rounded and a transition between the inner distal recess side walls 132 of the distal recess 122 and the distal shoulder 126 may optionally be curved or rounded. Alternatively, as illustrated in FIG. 7, the inner proximal recess side walls 131 of the proximal recess 121 and the proximal shoulder 125 are formed substantially perpendicular (or substantially 90°) relative to one another and the inner distal recess side walls 132 of the distal recess 122 and the distal shoulder 126 are also formed substantially perpendicular (or substantially 90°) relative to one another.

Figure 8:
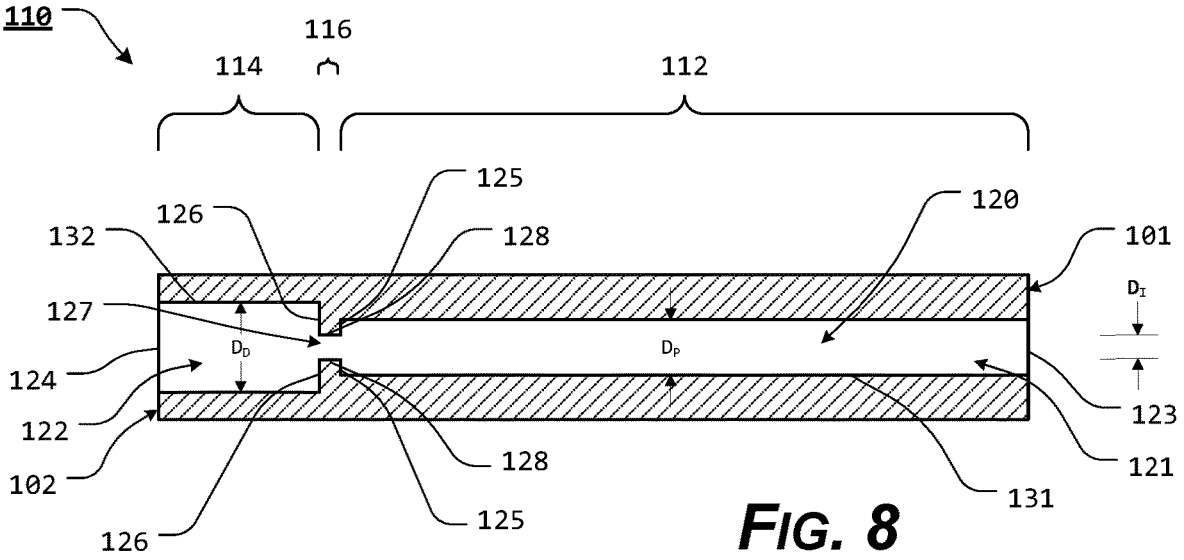
FIG. 8 illustrates a side, cross-sectional view of an exemplary embodiment of a snap-off smoking device, according to the presently disclosed systems, methods, and/or apparatuses.

In various exemplary embodiments, the proximal recess 121 has a substantially consistent inner proximal diameter, DP, the distal recess 122 as a substantially consistent inner distal diameter, Do, and the reduced diameter connector passage has an inner diameter, Di. As illustrated, the inner proximal diameter, DP, and the inner distal diameter, Do, are substantially similar, while the inner diameter, Di, is less than the inner proximal diameter, DP, or the inner distal diameter, Do. Alternatively, as illustrated in FIG. 8, the inner proximal diameter, DP, may be greater than or less than the inner distal diameter, Do.

Figure 9:
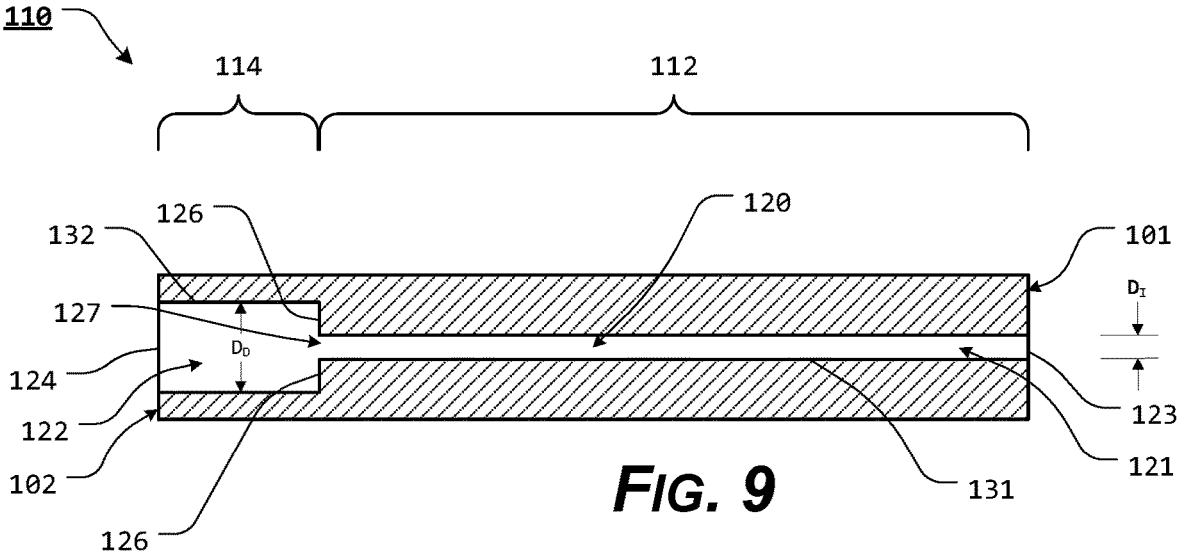
FIG. 9 illustrates a side, cross-sectional view of an exemplary embodiment of a snap-off smoking device, according to the presently disclosed systems, methods, and/or apparatuses.

In still other exemplary embodiments, as illustrated in FIG. 9, each borehole 120 may merely include the distal recess 122 extending to the distal shoulder 126, and the proximal recess 121 extending from the distal shoulder 126 to the open proximal outlet 123.

Figure 10:
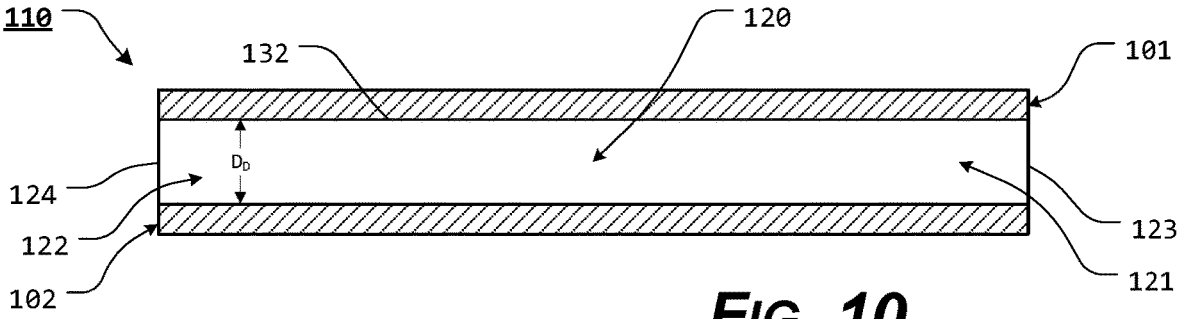
FIG. 10 illustrates a side, cross-sectional view of an exemplary embodiment of a snap-off smoking device, according to the presently disclosed systems, methods, and/or apparatuses.

In other exemplary embodiments, as illustrated in FIG. 10, each borehole 120 may have a constant inner distal diameter, Do, extending from the open distal inlet 124 to the open proximal outlet 123.

In various exemplary, nonlimiting embodiments, indicia 119 may optionally be formed as part of, applied to, embedded or etched in, or attached or coupled to a portion of the upper side surface 103 of the snap-off smoking device assembly 100. The indicia 119 may optionally be included so as to be present on or across several of the individual smoking device pipes 110 so as to form a coherent indicia 119 when the individual smoking device pipes 110 are included as part of the snap-off smoking device assembly 100. Alternatively, the indicia 119 may optionally be included so as to be present on individual smoking device pipes 110 when the individual smoking device pipes 110 are separated from the snap-off smoking device assembly 100 If included, the indicia 119 may represent a trademark or other word, phrase, or element, thereby providing additional originality to the snap-off smoking device assembly 100 and/or each individual smoking device pipe 110.

During use, a user is initially presented with a snap-off smoking device assembly 100. The scored lines 105 allow the user to separate or break off an individual smoking device pipe 110 from the snap-off smoking device assembly 100. Once an individual smoking device pipe 110 has been separated, a portion of *cannabis* or other desired smoking material can be positioned within at least a portion of the distal recess 122. Once appropriately inserted, the portion of *cannabis* or other desired smokable material can be ignited to be smoked through the individual smoking device pipe 100. Once the portion of *cannabis* or other desired smokable material is ignited, the user's lips can be placed around a portion of the proximal end 101 and the resulting smoke can be drawn through the reduced diameter connector passage 127, into the proximal recess 121, and through the proximal outlet 123.

It should also be appreciated that a more detailed explanation of the specific components of the snap-off smoking device assembly 100, instructions regarding how to snap-off an individual smoking device pipe 110, and methods for using an individual smoking device pipe 110, once separated from the snap-off smoking device assembly 100, and certain other items and/or techniques necessary for the implementation and/or operation of the various exemplary embodiments of the present disclosure are not provided herein because such background information will be known to one of ordinary skill in the art. Therefore, it is believed that the level of description provided herein is sufficient to enable one of ordinary skill in the art to understand and practice the systems, methods, and apparatuses of the presentation, as described.

While the presently disclosed systems, methods, and/or apparatuses have been described in conjunction with the exemplary embodiments outlined above, the foregoing description of exemplary embodiments, as set forth above, are intended to be illustrative, not limiting and the fundamental disclosure should not be considered to be necessarily so constrained. It is evident that the disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the disclosure. The upper and lower limits of these smaller ranges may independently be included in the smaller ranges and is also encompassed within the disclosure, subject to any specifically excluded limit in the stated range. Where the stated range includes one or both of the limits, ranges excluding either or both of those included limits are also included in the disclosure.

It is to be understood that the phraseology of terminology employed herein is for the purpose of description and not of limitation. Unless defined otherwise, all technical and scientific terms used herein have the same meaning as commonly understood by one of ordinary skill in the art to which this disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the disclosure, such that others may, by applying current knowledge, change, vary, modify, and/or adapt these exemplary, nonlimiting embodiments for various applications without departing from the spirit and scope of the disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A snap-off smoking device assembly, comprising:

a body formed of a portion of material and extending from a proximal end to a distal end and having an upper side surface and a lower side surface;

a series of spaced apart boreholes formed through said body, wherein each of said boreholes extends from said proximal end to said distal end; and one or more score lines formed at spaced apart locations along at least a portion of said upper side surface and/or said lower side surface, wherein each of said one or more score lines defines an area within which a discrete portion of said body can be removed from said snap-off smoking device assembly to form an individual smoking device pipe, and wherein one of said spaced apart boreholes is associated with at least one of said one or more score lines.

2. The snap-off smoking device assembly of claim 1, wherein said body is formed of a wood or wood material.

3. The snap-off smoking device assembly of claim 1, wherein said body is formed of a wood material selected from a group consisting of pine, cedar, spruce, fir, redwood, kenaf, oak, maple, cherry, mahogany, walnut, birch, ash, basswood, beech, aspen, alder, bamboo, palm, engineered wood, composite wood, and cellulosic materials.

4. The snap-off smoking device assembly of claim 1, wherein said body is at least partially impregnated with a material or fluid.

5. The snap-off smoking device assembly of claim 1, wherein said body is formed as a unitary, one-piece article.

6. The snap-off smoking device assembly of claim 1, wherein each of said one or more score lines is formed of an at least partial cut into or through said body.

7. The snap-off smoking device assembly of claim 1, wherein each of said one or more score lines extends substantially parallel to a longitudinal axis of said snap-off smoking device assembly.

8. The snap-off smoking device assembly of claim 1, wherein at least some of said one or more score lines extend from said upper side surface of said snap-off smoking device assembly and at least some of said one or more score lines extend from said lower side surface of said snap-off smoking device assembly.

9. The snap-off smoking device assembly of claim 1, wherein at least some of said one or more score lines extend from said upper side surface of said snap-off smoking device assembly and at least some of said one or more score lines extend from said lower side surface of said snap-off smoking device assembly, and wherein each of said one or more score lines that extends from said upper side surface is aligned with a corresponding one of said one or more score lines that extends from said lower side surface to define opposing pairs of said one or more score lines.

10. The snap-off smoking device assembly of claim 1, wherein each of said one or more score lines extends from said proximal end to said distal end.

11. The snap-off smoking device assembly of claim 1, wherein each of said one or more score lines are formed equidistant from one other.

12. The snap-off smoking device assembly of claim 1, wherein each of said one or more score lines includes a "V" groove.

13. The snap-off smoking device assembly of claim 1, wherein each of said one or more score lines includes a rounded or semicircular groove.

14. The snap-off smoking device assembly of claim 1, wherein each of said boreholes extends along said body, substantially parallel to a longitudinal axis of said body.

15. The snap-off smoking device assembly of claim 1, wherein each of said boreholes extends from said proximal end to said distal end and includes an outlet portion, a throat portion, and an inlet portion.

16. The snap-off smoking device assembly of claim 1, wherein each of said boreholes includes a proximal recess extending from an open proximal outlet formed in said proximal end and a distal recess extending from an open distal inlet formed in said distal end, wherein a reduced diameter connector passage is formed between said proximal recess and said distal recess, and wherein said reduced diameter connector passage has a reduced inner diameter when compared to an inner diameter of said proximal recess and/or an inner diameter of said distal recess.

17. The snap-off smoking device assembly of claim 16, wherein said reduced diameter connector passage provides fluid communication between said proximal recess and said distal recess.

18. The snap-off smoking device assembly of claim 16, wherein said reduced diameter connector passage is formed closer to said distal end than to said proximal end.

19. A snap-off smoking device assembly, comprising:

a monolithic body extending from a proximal end to a distal end and having an upper side surface and a lower side surface;

spaced apart boreholes formed through said body, wherein each of said boreholes extends from said proximal end to said distal end; and score lines formed at spaced apart locations along at least a portion of said upper side surface and/or said lower side surface, wherein each of said score lines defines an area within which a discrete portion of said body can be removed from said snap-off smoking device assembly to form an individual smoking device pipe, and wherein a single, discrete one of said spaced apart boreholes is associated with each individual smoking device pipe.

20. A snap-off smoking device assembly, comprising:

a body extending from a proximal end to a distal end and having an upper side surface and a lower side surface, wherein said body is formed as a unitary, one-piece article;

spaced apart boreholes formed through said body, wherein each of said boreholes extends from said proximal end to said distal end, wherein each of said boreholes includes a proximal recess extending from an open proximal outlet formed in said proximal end and a distal recess extending from an open distal inlet formed in said distal end, wherein a reduced diameter connector passage is formed between said proximal recess and said distal recess, and wherein said reduced diameter connector passage has a reduced inner diameter when compared to an inner diameter of said proximal recess and/or an inner diameter of said distal recess; and score lines formed at spaced apart locations along at least a portion of said upper side surface and/or said lower side surface, wherein each of said score lines extends from said proximal end to said distal end, wherein each of said score lines defines an area within which a discrete portion of said body can be removed from said snap-off smoking device assembly to form an individual smoking device pipe, and wherein a single, discrete one of said spaced apart boreholes is associated with each individual smoking device pipe.

* * * * *